United States Patent [19]

Mertens et al.

[11] 4,373,244

[45] Feb. 15, 1983

[54] METHOD FOR RENEWING THE BRICKWORK OF COKE OVENS

[75] Inventors: Walter Mertens; Heinz Thubeauville; Wilhelm Glittenberg, all of Bochum, Fed. Rep. of Germany

[73] Assignee: Dr. C. Otto & Comp. G.m.b.H., Bochum, Fed. Rep. of Germany

[21] Appl. No.: 153,144

[22] Filed: Oct. 28, 1980

[30] Foreign Application Priority Data

May 25, 1979 [DE] Fed. Rep. of Germany ..... 2921171

[51] Int. Cl.[3] ..... B23P 7/00

[52] U.S. Cl. ..... 29/402.08; 202/267 R; 29/402.11

[58] Field of Search ..... 29/402.08, 402.09, 402.11; 202/267 R, 267 A, 270; 201/41

[56] References Cited

U.S. PATENT DOCUMENTS 4,059,885 11/1977 Oldengott ..... 29/402.09

*Primary Examiner*—Francis S. Husar
*Assistant Examiner*—V. K. Rising
*Attorney, Agent, or Firm*—Thomas H. Murray

[57] ABSTRACT

Brickwork near the outer ends of horizontal coke ovens which forms vertical heating flues in heating walls is renewed by a method wherein the oven chambers at opposite sides of the heating wall are partitioned by vertical walls. These vertical walls are located at a point inwardly in the oven chambers so that a vertical cut can be made through the oven wall of the innermost heating flue to be repaired. The brickwork in front of the vertical cut is then pulled down. New parts for the oven wall are connected to existing parts by oven bricks which have a lug that is arranged when installed so that the lug extends along the heating flue side to engage over existing oven bricks.

2 Claims, 5 Drawing Figures

METHOD FOR RENEWING THE BRICKWORK OF COKE OVENS

BACKGROUND OF THE INVENTION

This invention relates to a method for renewing the brickwork of vertical heating flues in heating walls near the outer ends of horizontal coke ovens. More particularly, the present invention provides a method wherein replacement brickwork is selected to include oven bricks, each having a projecting lug extending from a side thereof for engagement over the existing oven brickwork at a vertical section through the heating wall and on the heating flue side thereof.

In horizontal coke ovens, the heating flues near the ends are formed by brickwork of heating walls, sometimes called oven walls herein, between the oven chambers and the flues. Other brickwork for the heating flues includes walls sometimes called midfeathers arranged as separators to form discrete areas of the flues. Near the ends of the oven chambers the brickwork is subject to more severe wear than the brickwork at the central part of the oven chambers. Sometimes, therefore, repairs are made only to the brickwork of the heating walls near the end portions of the oven chambers up to, for example, the second, third or fourth flue. In the repair process, the heating flues located in the heating walls toward the central portion of the oven chamber are operated at a temperature which is sufficient to insure combustion of a relatively small amount of gas supplied to these flues. Operating the flues in this manner prevents the occurrence of appreciable changes to the structure of the bricks. The internal parts of the oven chambers are sealed off by vertical walls that are sometimes referred to hereinafter as partitions. However, coke undergoing processing in the oven chamber may be removed previously or the coke may be left in the oven chamber under certain circumstances. The top of the oven is propped up above the parts to undergo repair whereas the bottom of the oven, the regenerator foundation and gas inlets all remain untouched even if gas is supplied through the ducts under the heating flues. The inlet ducts also supply gas to the flues in the central part of the heating wall but the supply of gas to the heating flues at the ends of the oven chamber requiring renewal is cut off by pipe members inserted into the supply inlets.

In this process of renewing the brickwork of the heating flues, it is necessary to solve the problem of forming a gastight seal between the existing brickwork and the new brickwork after the new brickwork has been heated. The existing brickwork remains at a relatively high temperature during the restoration process, while the new brickwork must be heated gradually so as to expand in a conventional manner.

SUMMARY OF THE INVENTION

To meet the need for renewing brickwork in heating flues and solve the problem identified above, the present invention provides a method for renewing the brickwork of vertical heating flues in heating walls near the outer ends of horizontal coke ovens, the method including the steps of forming a vertical section through the heating wall at the innermost internal end of the heating flue requiring repair, removing the brickwork in front of the vertical section, selecting replacement brickwork including oven bricks each having a projecting lug extending from the side thereof, installing oven bricks with the projecting lugs so that the lugs extend into engagement over the existing oven brick at the heating flue side of the heating wall along the vertical section, and installing replacement brickwork to form the remaining part of the brickwork for the heating flues.

Thus, the present invention provides a method wherein the vertical section is made through the oven wall at the internal end of the innermost of the heating flue requiring repair so that the brickwork in front of the vertical section can be pulled down. The renewed part of the oven wall is connected to the existing part by oven bricks each having a lug on the heating flue side thereof to engage over the existing oven bricks. The joint between the new and old oven bricks ends at the lug. The joint can taper therefrom to prevent the falling out of mortar during the heating process.

In known repair procedures, overlapping oven bricks at the boundry surface between the existing and the new brickwork are released from the bond to thereby form a toothed joint. When the new brickwork is joined or installed, consideration must be given to the fact that a period time is required to heat the oven to an elevated temperature and during the heating process normal expansion of the brickwork will occur. In the known repair methods, therefore, it was necessary to add the new brickwork in portions and heat it in portions.

On the other hand, when a vertical cut is made in existing brickwork, the new brickwork can be built up along the entire length of the cut without interruption. The new part of the oven wall can be simultaneously heated and the occurring expansion takes place without complications.

These features and advantages of the present invention as well as others will be more fully understood when the following description is read in light of the accompanying drawings, in which.

Figure 1:
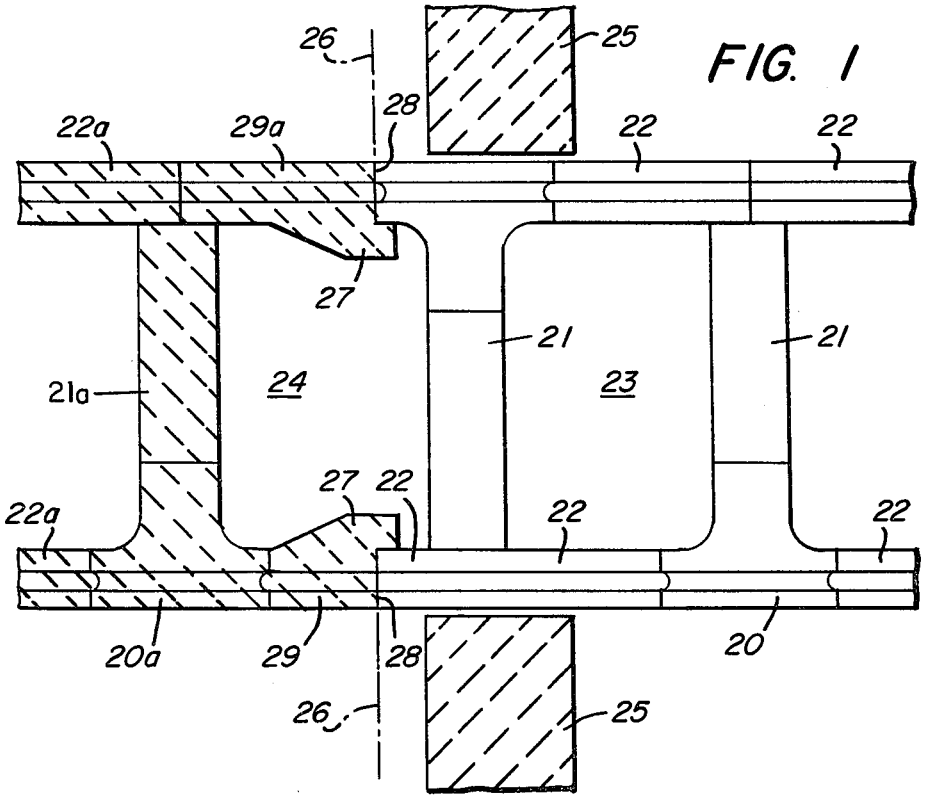
FIG. 1 is a horizontal section through a heating wall illustrating the heating flues therein after restoration of a portion thereof according to the process of the present invention.

The heating wall arrangement shown in FIG. 1 includes bricks 20 having a hammerhead engaged in the oven wall and abutting midfeather bricks 21 which, in turn, smoothly abut with oven bricks 22 at the heating flue side of the oven wall. The portion of the hammerhead brick 20 extending in the heating wall is adjoined at its opposite sides by oven bricks 22. The next course of bricks is reversed so that the parts of oven bricks 22 are situated on top of hammerhead brick 20 and a hammerhead brick 20 is situated above the joint between oven bricks 22 for the other heating wall. The oven bricks 20–22 form a heating flue 23 and, for the purpose of disclosing the method of the present invention, represent existing brickwork which is not shown with hatched lines in FIG. 1 for better distinction from replacement brickwork which is shown with hatched lines.

Figure 2:
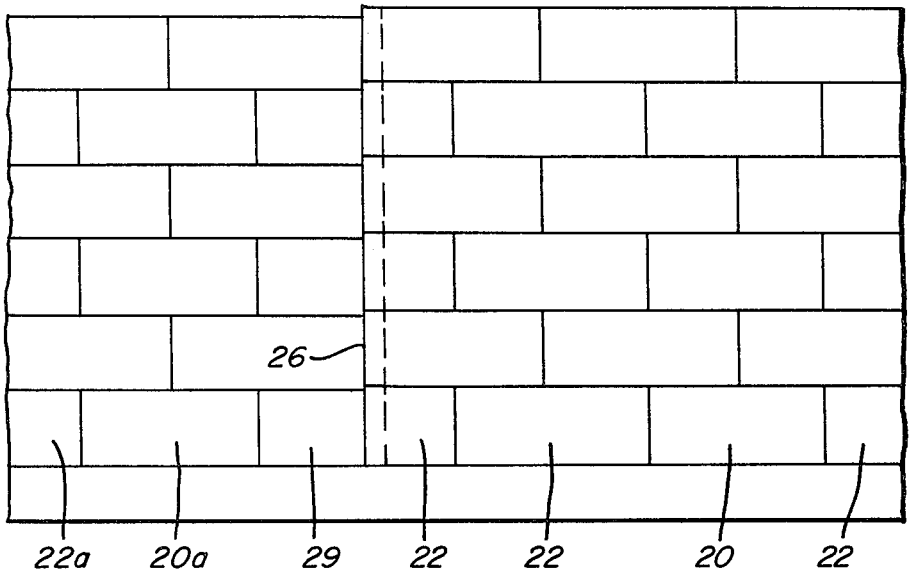
FIG. 2 is a partial elevational view of a heating wall shown in FIG. 1.

The replacement brickwork includes bricks 20*a*, 21*a* and 22*a* which are similar to bricks 20, 21, and 22, respectively. It will be assumed for the purpose of disclosing the method of the present invention that the brickwork surrounding heating flue 23 is not deteriorated or damaged so that it can remain untouched, whereas the original brickwork surrounding heating flue 24 and the additional flues toward the end of the oven chambers must be renewed. A partition wall 25 is constructed in each of the adjacent oven chambers at a location that is substantially opposite the midfeather between flues 23 and 24, thus providing an insulating enclosure. In FIGS. 1 and 2, reference numeral 26 denotes a vertical dividing plane bounded by existing brickwork. After partition walls 25 have been built and cooling has proceeded to a point where work can be carried out on the walls of the oven chamber, the two oven walls are sawed through along plane 26. Only bricks 22 are cut by the sawing operation since bricks 20 form a joint along plane 26. The existing brickwork to be renewed forming heating flues from parting line 26 to the end of the oven chamber is then pulled down.

Figure 5:
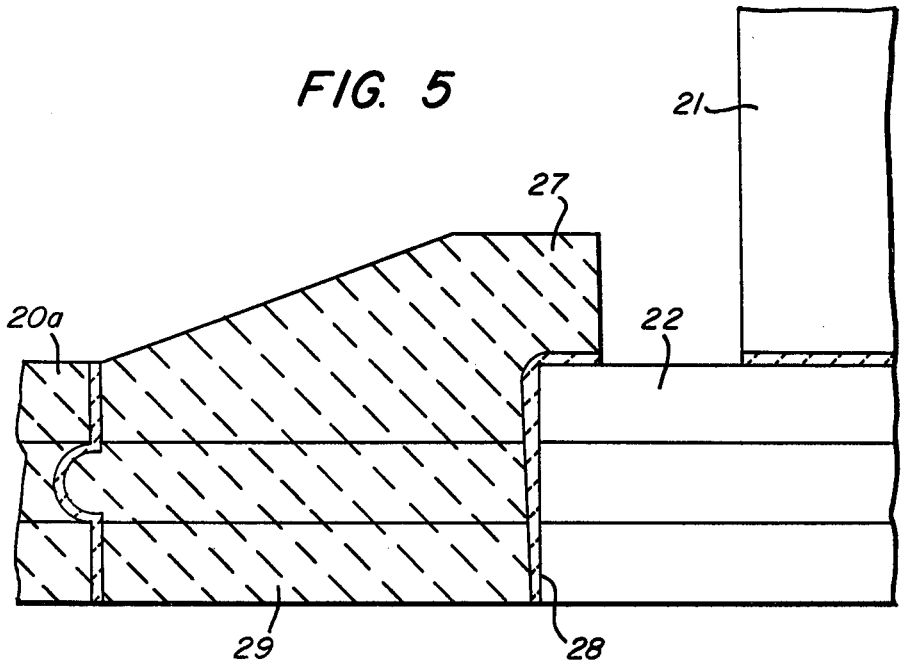
FIG. 5 is an enlarged view to illustrate the joint between old and new brickwork according to the arrangement of parts shown in FIG. 1.

Similarly-shaped bricks are then selected for use to form the renewed part of the heating flue or flues. However, the selection of replacement bricks includes bricks 29 and 29*a* each having a lug or projection 27 that is oriented when installed so that the brick abuts against the existing brickwork at plane 26 while the projection 27 extends over the existing part of the oven wall at the flue side thereof. As shown in FIG. 5, a joint 28 extends between the existing brickwork and the new brickwork. The joint extends from the inner side of lug 27 across the abutting end faces of bricks 29 and 22 where the joint takes the form of a wedge that widens in a direction from the oven chamber to the flue. This arrangement provides that the bricks 29 and 22 bear more closely to one another at the side of the joint facing the oven chamber, thus preventing the falling out of mortar from the joint when the bricks 29 and 29*a* expand.

Figure 4:
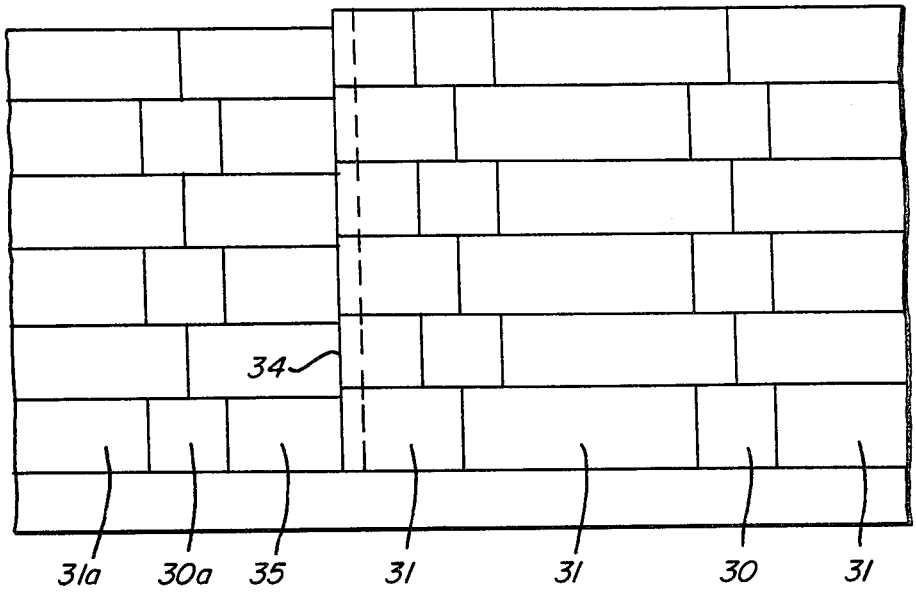
FIG. 4 is a partial elevational view of a heating wall shown in FIG. 3.
Figure 3:
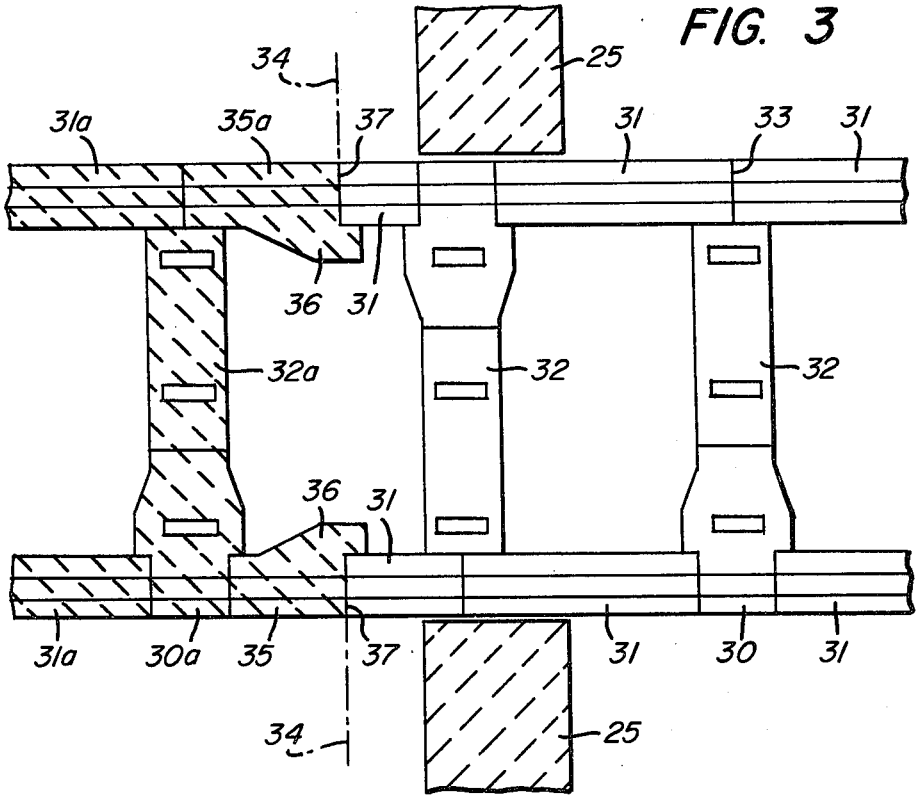
FIG. 3 is a view similar to FIG. 1 but illustrating a different arrangement of bricks forming flues in a heating wall.

FIGS. 3 and 4 illustrate different forms of bricks used to form an oven wall over the forms of bricks shown and previously described in regard to FIGS. 1 and 2. In FIGS. 3 and 4, the arrangement of bricks is made up of a midfeather end brick 30 which extends through the oven wall. Oven bricks 31 abut against opposite sides of oven bricks 30. Midfeather bricks 32 abut between the end brick 30 and the joint 33 at the heating flue side of abutting oven bricks 31. Replacement brickwork includes bricks 30*a*, 31*a* and 32*a* which are shaped in a similar manner to bricks 30, 31 and 32, respectively. As previously described in regard to FIGS. 1 and 2, walls 25 are built at a site in the oven chambers which is opposite the midfeather of a flue formed of bricks that do not require renewal. The brickwork to be repaired is removed by first sawing through the existing brickwork along a dividing plane 34. When the heating walls consist of brickwork of the type shown in FIGS. 3 and 4, a brick 31 must be sawed through in each of the courses. The damaged brickwork of the heating flue or flues at the oven end is the pulled down.

During rebuilding, new brickwork is connected to the existing brickwork by bricks 35 at one heating wall and bricks 35*a* at the opposite side of the flue of the oven wall. Bricks 35 and 35*a* each are formed with a lug 36 which, like the bricks 29 and 29*a* in FIGS. 1 and 2, is installed so that the lug projects inwardly in the heating flue to extend over the existing oven bricks. The resulting joint 37 is formed in the same manner as already described in regard to joint 28 and shown in FIG. 5. The method of the present invention for renewing brickwork can be used to insure a gastight seal at joints 28 and/or 37 both when the repaired part of the heating wall is heated and when all of the flues are reheated to an operating temperature.

In view of the foregoing description, it now is believed apparent that the present invention provides a particularly effective method of partly renewing the brickwork of vertical heating flues of horizontal coke ovens. The renewed part of the brickwork forms heating flues near the ends of the oven chambers of horizontal coke ovens. By this renewing method, the brickwork which suffers more severe wear than the central part of the heating flues can be readily replaced. In some instances, therefore, repairs are only necessary to the brickwork of the heating flues near the oven ends up to the second, third or fourth heating flue. During the rebuilding operation, the heating flues toward the center remain at a higher temperature since the internal parts of the oven chambers are partitioned off by the vertical walls 25.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A method for renewing the brickwork of vertical heating flues in heating walls near the outer ends of horizontal coke ovens, said method including the steps of forming a vertical section through the heating wall at the innermost internal end of the heating flue requiring repair, removing the brickwork in front of the vertical section, selecting replacement brickwork including oven bricks each having a projecting lug extending from a side thereof, installing the oven bricks with the projecting lugs extending into engagement over existing oven brick on the heating flue side of the heating wall along said vertical section and installing replacement brickwork to form the remaining part of the removed brickwork.

2. The method according to claim 1 including the further step of forming a joint ending at each projecting lug of said oven bricks to taper outwardly between such bricks and brickwork defining said vertical section.

* * * * *